US005711701A

United States Patent [19]

Grinderslev et al.

[11] Patent Number: 5,711,701

[45] Date of Patent: Jan. 27, 1998

[54] UNIVERSAL POLISHING FIXTURE FOR HOLDING CONNECTORS

[75] Inventors: Soren Grinderslev, Hummelstown; Randall B. Paul, Elizabethville, both of Pa.

[73] Assignee: The Whitaker Corporation, Wilmington, Del.

[21] Appl. No.: 756,465

[22] Filed: Nov. 26, 1996

Related U.S. Application Data

[63] Continuation-in-part of Ser. No. 668,028, Jun. 19, 1996, Pat. No. 5,643,064.

[51] Int. Cl.[6] ..... B24B 1/00

[52] U.S. Cl. ..... 451/378; 451/41; 451/386; 451/392; 451/229; 451/287

[58] Field of Search ..... 451/41, 378, 386, 451/391, 229, 287

[56] References Cited

U.S. PATENT DOCUMENTS

| | | | |
|---|---|---|---|
| 4,693,035 | 9/1987 | Doyle | 51/125 |
| 4,819,386 | 4/1989 | Struyf | 51/281 R |
| 4,831,784 | 5/1989 | Takahashi | 51/131.1 |
| 4,905,415 | 3/1990 | Moulin | 51/124 R |
| 5,109,460 | 4/1992 | Baek et al. | 385/115 |
| 5,140,779 | 8/1992 | Grois | 51/217 R |
| 5,216,846 | 6/1993 | Takahashi | 51/326 |
| 5,321,917 | 6/1994 | Franklin et al. | 51/217 R |
| 5,643,064 | 7/1997 | Grinderslev et al. | 451/41 |

FOREIGN PATENT DOCUMENTS

| | | | |
|---|---|---|---|
| 0 579 056 A1 | 1/1994 | European Pat. Off. . | |
| 0 621 107 A1 | 10/1994 | European Pat. Off. . | |
| 0 657 247 A2 | 6/1995 | European Pat. Off. . | |
| 61-113005 | 5/1986 | Japan | G02B 6/00 |
| 2 272 658 A | 5/1994 | United Kingdom | B24B 19/22 |
| WO 96/14960 | 5/1996 | WIPO | B24B 19/22 |

OTHER PUBLICATIONS

SFP-550 PAC Ploishing Machine Operating Manual; 22 pages.

Seikoh Giken SFP-70D Polishing Machine For PC and PAC Connector Operating Manual; 28 pages.

PCT International Search Report; International Application No. PCT/US96/14361; International Filing Date May 9, 1996.

*Primary Examiner*—Robert A. Rose
*Assistant Examiner*—George Nguyen

[57] ABSTRACT

A polishing fixture (20) having nests (48) for releasably holding optical fiber connectors during polishing, inclined beams (44a) being deflectable to narrow the nests (48) and hold optical fiber connectors received in the nests (48), and a force transmitting body (26) avoiding jamming against the inclined beams (44a) by being moveable beside each of the beams (44a) in a direction that unopposes the direction toward which deflected portions of the inclined beams (44a) point.

5 Claims, 3 Drawing Sheets

UNIVERSAL POLISHING FIXTURE FOR HOLDING CONNECTORS

CROSS REFERENCE TO RELATED APPLICATION

This application is a continuation in part of application Ser. No. 08/668,028, filed Jun. 19, 1996, U.S. Pat. No. 5,643,064.

FIELD OF THE INVENTION

The invention relates to a polishing fixture for holding optical fiber connectors during a polishing operation.

BACKGROUND OF THE INVENTION

A known polishing apparatus, disclosed in U.S. Pat. No. 5,321,917, comprises, nests for releasably holding optical fiber connectors during polishing, at least portions of the nests being moveable by deflection of deflectable beams, the beams being deflectable to narrow the nests and hold optical fiber connectors received in the nests.

According to U.S. patent application, Ser. No. 08/668,028, filed Jun. 19, 1996, attorney docket 16243, a polishing fixture is disclosed as being constructed with the nests, and with the deflectable beams. The beams are along a perimeter of a plate. A force transmitting body, in the form of a ring, for example, encircles the perimeter of the plate. Each of the beams is deflectable by engagement with at least one of multiple protruding working surfaces spaced apart along the ring.

The ring is rotatable in a first direction to deflect the beams inward relative to the perimeter of the plate and narrow the nests. The ring is rotatable in a reverse direction to allow the beams to spring outward and widen the nests. A post on the plate is captive along a slot through the ring to limit both forward and reverse rotation of the ring.

It has been found that reverse rotation of the ring tends to jam the beams against the ring. This is due to the deflected portions of the beams being inclined, biased against the ring, and pointing in a direction that opposes the direction of rotation. When the ring is urged to rotate in reverse against the inclined and biased beams, the beams become wedged against the ring, requiring an increase in torque applied to the ring to overcome the wedged beams before further rotation in reverse can occur. This causes difficulty when releasing optical fiber connectors from their being held by the polishing fixture.

SUMMARY OF THE INVENTION

According to the invention, a force transmitting body avoids jamming against inclined beams, by the force transmitting body being moveable in a direction that unopposes the direction toward which deflected portions of the inclined beams point, to disengage from the beams.

The invention can be applied to an embodiment of a ring, to disengage the ring from the beams while avoiding a tendency to jam the beams against the ring. By moving the ring in a direction that unopposes the direction toward which the deflected portions of the inclined beams point, the ring is easily disengaged from the beams to allow release of the optical fiber connectors from their being held by nests of the polishing fixture.

According to an embodiment of the invention, a polishing fixture having nests for releasably holding optical fiber connectors during polishing comprises, at least portions of the nests being moveable by deflection of deflectable beams, the beams being deflectable to narrow the nests and hold optical fiber connectors received in the nests, each of the beams being deflectable by engagement with at least one of multiple protruding working surfaces spaced apart along a force transmitting body, and the force transmitting body avoiding jamming against the beams by being moveable in a direction that unopposes the direction toward which the deflected portions of the inclined beams point to disengage the working surfaces from the beams and widen the nests.

According to a further feature of the invention, the force transmitting body is moveable beside each of the beams in repeated increments of movement to engage each beam with consecutive working surfaces. The consecutive working surfaces advantageously substitute different patterns of wear on the beams.

According to a further feature of the invention, indicator marks on the force transmitting body advantageously indicate increments of movement of the force transmitting body.

According to a further embodiment, the beams are angularly spaced apart along a perimeter of a plate, and the working surfaces are along a rim of a ring encircling the perimeter.

An embodiment of the invention will now be described by way of example with reference to the accompanying drawings, according to which:

DETAILED DESCRIPTION OF THE PREFERRED EMBODIMENT

Figure 1:
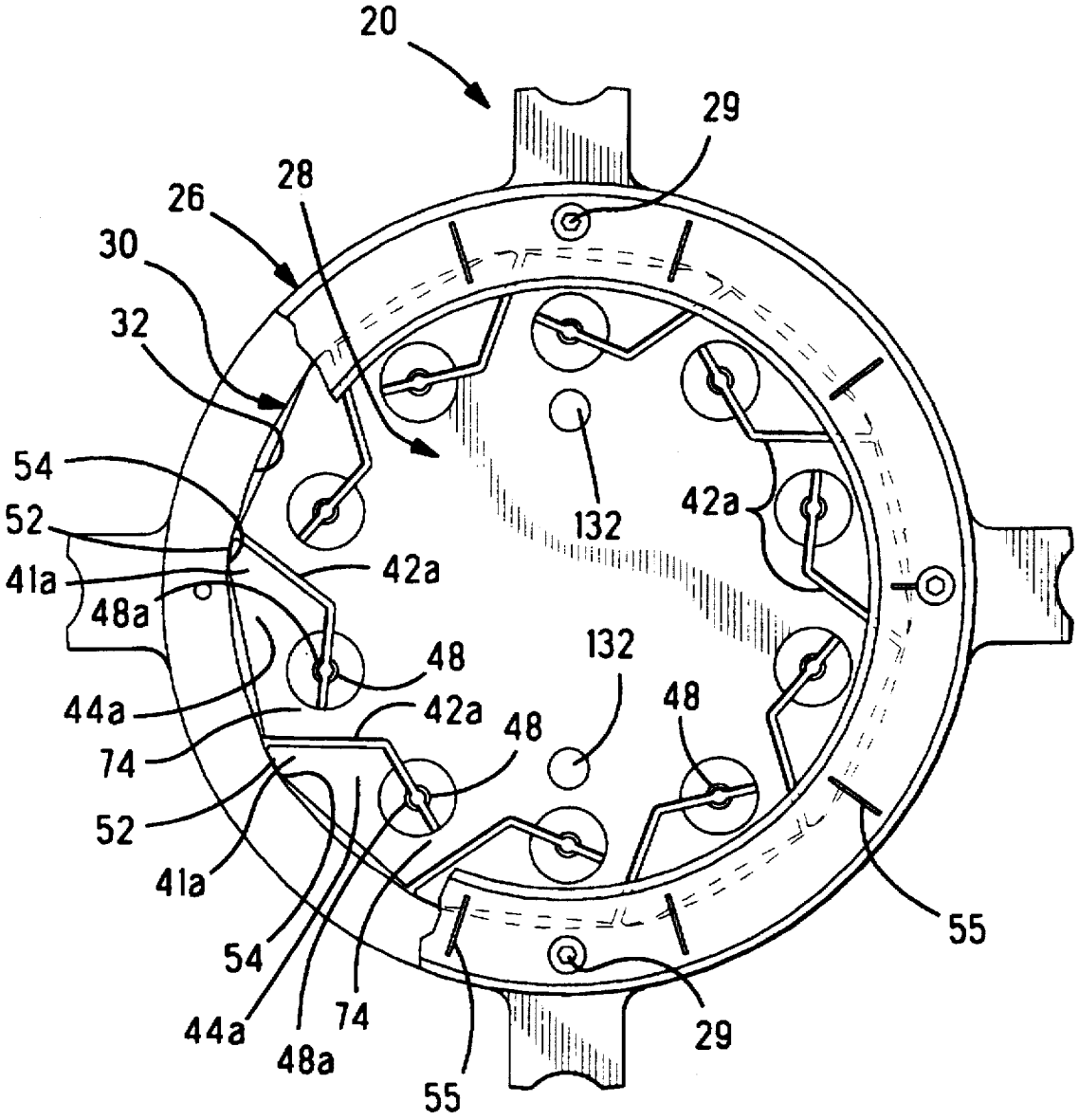
FIG. 1 is a fragmentary top view with parts broken away of a polishing fixture constructed with a force transmitting body and a holder plate having nests and beams.
Figure 2:
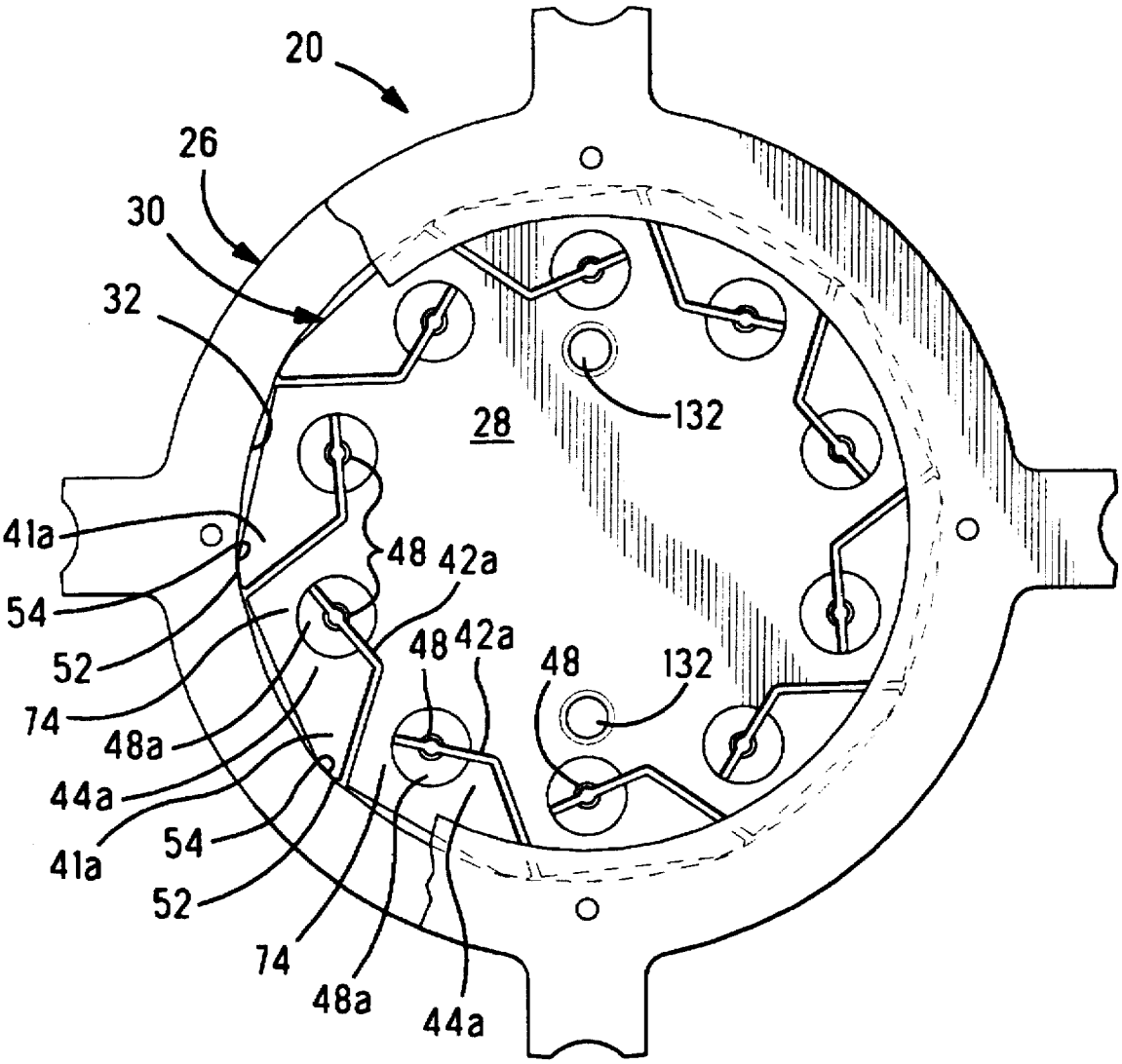
FIG. 2 is a fragmentary bottom view of the polishing fixture as shown in FIG. 1.

With reference to FIGS. 1 and 2, a polishing fixture 20 comprises, a force transmitting body 26 in the form of a cam ring 26 having arms 56 for mounting to a polishing machine, not shown, and a connector holding plate 28 for holding optical fiber connectors. The holder plate 28 has a perimeter 30 that mates with an internal rim 32 on the cam ring 26 and registration holes 132 that are received over posts of a set up plate, not shown.

Multiple clamping assemblies **41*a* are angularly spaced along the perimeter 30. Each of the clamping assemblies 41*a* has a slot 42*a*, a beam 44*a* and a nest 48. The slot 42*a* is a nonlinear slot 42*a* extending from the perimeter 30 and through a corresponding nest 48. A portion of the nest 48*a*, beside the slot 42*a* and on the beam 44*a*, is moved by deflection of the beam 44*a***.

The beams **44*a* are deflected by movement of a cam assembly 51 that comprises, convex cam surfaces 52 on deflected portions of the beams, and working surfaces 54 on an internal rim 32 of the force transmitting body 26. Further details of the polishing fixture 20** and its construction and operation are disclosed in U.S. patent application, Ser. No. 08/668,028, filed Jun. 19, 1996, incorporated herein by reference.

According to an embodiment of the invention, the polishing fixture 20 having the nests 48 for releasably holding optical fiber connectors during polishing comprises, at least portions of the nests 48 being moveable by deflection of the deflectable beams 44a, the beams 44a being deflectable to narrow the nests 48 and hold optical fiber connectors which have been received in the nests 48, each of the beams 44a being deflectable by engagement of the cam surface 52 thereon with at least one of the multiple protruding working surfaces 54 spaced apart along the internal rim 32 on the force transmitting body 26. Upon movement of the force transmitting body 26 beside the beams 44a, respective working surfaces 54 slidably engage and drive against respective beams 44a to deflect the beams 44a inward of the perimeter 30. Thereby, portions of the nests 48 are moved by deflection of the beams 44a to narrow the nests 48 and close on optical fiber connectors in respective nests 48.

Figure 4:
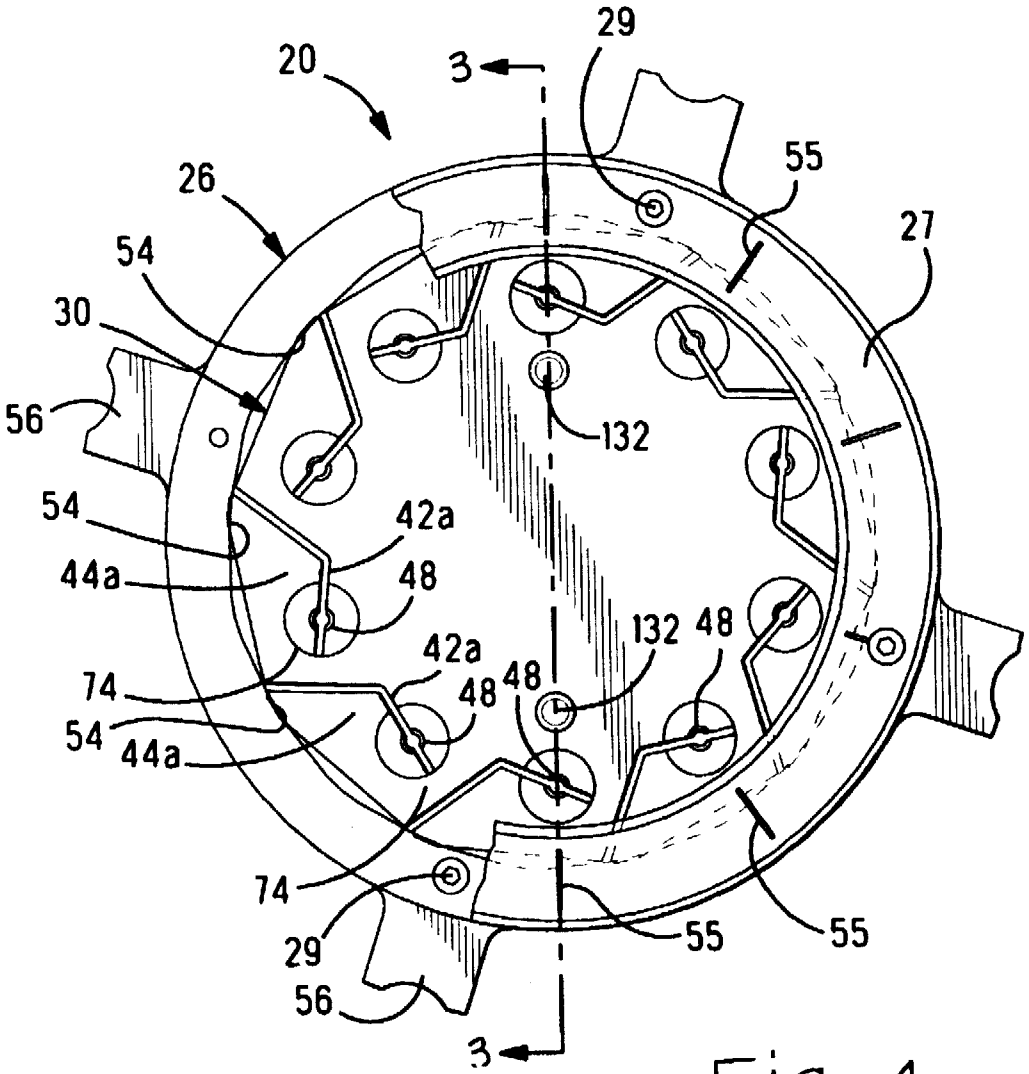
FIG. 4 is a fragmentary top view of the polishing fixture with the beams deflected.
Figure 3:
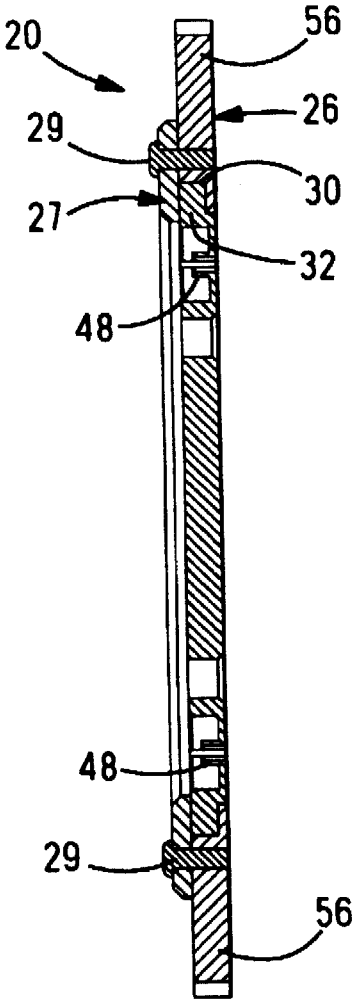
FIG. 3 is a view in cross section of the polishing fixture as shown in FIGS. 1 and 2.

Each of the beams 44a has a pivot that is a root end 74 and a deflected portion that deflects pivotally about the root end 74. Since each of the beams 44a is a cantilever beam, the beam is supported by the root end 74 that is also a pivot. A cantilever, unsupported portion of the beam 44a is further a deflected portion of the beam 44a. When the beams 44a are deflected by engagement with the working surfaces 54 on the force transmitting body 26, the deflected portions of the beams 44a deflect to incline the beams 44a and to bias the beams 44a against the force transmitting body 26. The deflected portions of the inclined beams 44a point obliquely outward of the perimeter 30 toward the force transmitting body 26. As shown in the top view of FIG. 4, the beams 44a point partly in a direction clockwise along the perimeter 30, and point partly obliquely outward of the perimeter 30 toward the force transmitting body 26 against which the beams 44a are inclined and biased.

The force transmitting body 26 avoids jamming against the inclined beams 44a by being moveable in a direction that unopposes the direction toward which deflected portions of the inclined beams 44a point, thereby, to disengage the working surfaces 54 from the beams 44a and widen the nests 48. When the nests 48 have been widened, the optical fiber connectors can be removed easily from the nests 48. As shown in the top view of FIG. 4, the force transmitting body 26 in the form of a ring 26 has been moved clockwise to engage certain working surfaces 54 against the beams 44a to deflect the beams 44a. To disengage the working surfaces 54 from engagement with the deflected beams 44a, the force transmitting body 26 must undergo further movement.

It has been found that reverse rotation of the ring 26 tends to jam the beams 44a against the ring 26. This is due to the beams 44a being inclined to point the deflected portions in a direction that opposes the direction of rotation or movement of the ring 26. When the ring 26 is urged to rotate in reverse against the inclined beams 44a, the beams 44a become wedged against the ring 26, requiring an increase in torque applied to the ring 26 to overcome the wedged beams 44a before further rotation in reverse can occur. This causes difficulty when releasing optical fiber connectors from their being held by the nests 48 on the polishing fixture 20.

The embodiment shown in FIGS. 1–4 overcomes this difficulty by allowing the ring 26 to move clockwise, the force transmitting body 26 in the form of the ring 26 avoiding jamming against the beams 44a by being moveable in a direction that unopposes the direction toward which the deflected portions of the inclined beams 44a point to disengage the working surfaces 54 from the beams 44a and widen the nests 48.

According to a further feature of the invention, the force transmitting body 26 is moveable beside each of the beams 44a in repeated increments of movement to engage each beam 44a with consecutive working surfaces 54. The consecutive working surfaces 54 advantageously substitute different patterns of wear on the beams 44a.

According to a further feature of the invention, indicator marks 55 on the force transmitting body 26 advantageously indicate increments of movement of the force transmitting body 26. The indicator marks 55 become aligned radially with respective nests 48, FIG. 4, to indicate maximum closure of the nests Following incremental movement of the force transmitting body 26, the indicator marks 55 become displaced to positions offset radially from the nests 48, FIG. 1, to indicate that the beams 44a have been disengaged from the working surfaces According to a further feature, the force transmitting body 26 further comprises a bezel 27. The bezel 27 is secured by fasteners 29 to a remainder of the force transmitting body 26. The perimeter 30 of the holder plate 28 is overlapped on opposite sides by the bezel 27 and the remainder of the force transmitting body 26. Thereby, the holder plate 28 is supported without fasteners in a horizontal plane, resistant to tipping and resistant to deflection relative to the force transmitting body 26. Further, the bezel 27 and the remainder of the force transmitting body 26 maintain sufficient clearance to retain the holder plate 28 for relative rotational movement. Dimensional tolerances of the rim 32 are minimized to prevent pivotal movement of the holder plate 22 relative to the force transmitting body 26. The force transmitting body 26 in the form of a ring 26 can be made of aluminum, while the holder plate 22 can be a polymer material or of the same material as the ring 26. A coating of low friction material, such as Teflon, can be applied to the cam surfaces on the beams 44a to reduce friction and wear.

Although a preferred embodiment has been disclosed, other embodiments and modifications of the invention are intended to be covered by the spirit and scope of the appended claims.

What is claimed is:

1. A polishing fixture having nests for releasably holding optical fiber connectors during polishing, comprising:

at least portions of the nests being moveable by deflection of deflectable beams, the beams being deflectable to narrow the nests and hold optical fiber connectors received in the nests, each of the beams being deflectable by engagement with at least one of multiple protruding working surfaces spaced apart along a force transmitting body, and the force transmitting body avoiding jamming against the beams by being moveable beside each of the beams in a direction that unopposes a direction toward which respective deflected portions of the inclined beams point to disengage working surfaces from the beams and allow release of optical connectors in respective nests.

2. A polishing fixture as recited in claim 1 wherein, the force transmitting body is moveable beside each of the beams in repeated increments of movement to engage each beam with consecutive working surfaces.

3. A polishing fixture as recited in claim 1 wherein, indicator marks on the force transmitting body indicate increments of movement of the force transmitting body.

4. A polishing fixture as recited in claim 1 wherein, the beams are angularly spaced apart along a perimeter of a plate, and the working surfaces are along a rim of a ring encircling the perimeter.

5. A polishing fixture as recited in claim 4 wherein, a perimeter of the plate is supported for relative rotation between a bezel on the force transmitting body and a remainder of the force transmitting body.

* * * * *